US008059056B2

(12) United States Patent
Ma et al.

(10) Patent No.: US 8,059,056 B2
(45) Date of Patent: Nov. 15, 2011

(54) DIRECTIONAL ANTENNA AND PORTABLE ELECTRONIC DEVICE USING THE SAME

(75) Inventors: Chin-Hung Ma, Taoyuan County (TW); Shih-Liang Tsai, Taoyuan County (TW)

(73) Assignee: Foxconn Communication Technology Corp., Taoyuan County (TW)

( * ) Notice: Subject to any disclaimer, the term of this patent is extended or adjusted under 35 U.S.C. 154(b) by 998 days.

(21) Appl. No.: 11/961,156

(22) Filed: Dec. 20, 2007

(65) Prior Publication Data

US 2009/0109118 A1 Apr. 30, 2009

(30) Foreign Application Priority Data

Oct. 31, 2007 (TW) ..... 96140955 A

(51) Int. Cl.
*H01Q 19/00* (2006.01)
*H01Q 3/24* (2006.01)

(52) U.S. Cl. ..... 343/833; 343/836; 343/876

(58) Field of Classification Search ..... 343/702, 343/846, 833, 834, 700 MS, 876, 912, 835, 343/836

See application file for complete search history.

(56) References Cited

U.S. PATENT DOCUMENTS

| | | | | |
|---|---|---|---|---|
| 7,439,921 | B2 * | 10/2008 | Hu et al. | 343/702 |
| 7,656,353 | B2 * | 2/2010 | Qi et al. | 343/702 |
| 7,834,813 | B2 * | 11/2010 | Caimi et al. | 343/745 |
| 2005/0184914 | A1 * | 8/2005 | Ollikainen et al. | 343/702 |
| 2008/0001824 | A1 * | 1/2008 | Castaneda et al. | 343/700 MS |

FOREIGN PATENT DOCUMENTS

WO WO2005041350 * 5/2005

* cited by examiner

*Primary Examiner* — Jocob Y Choi
*Assistant Examiner* — Robert Karacsony
(74) *Attorney, Agent, or Firm* — Altis Law Group, Inc.

(57) ABSTRACT

A directional antenna and a portable electronic device using the same are provided. The directional antenna includes L-shaped radiator, L-shaped oscillator, and L-shaped reflector and it is preferred that the directional antenna is positioned at corners of the substrate. The L-shaped radiator is made resonant by the L-shaped oscillator and has higher gain to maximize performance of signal transmission. The directional antenna achieves signal transmission in a specific direction over a long distance by the L-shaped reflector. In addition, with the gravity sensor, the processor and the switches, the directional antenna is automatically adjusted to a predetermined direction to transmit and receive signals even through orientation of the electronic device is changing at any time.

19 Claims, 5 Drawing Sheets

DIRECTIONAL ANTENNA AND PORTABLE ELECTRONIC DEVICE USING THE SAME

BACKGROUND OF THE INVENTION

1. Field of the Invention

The present invention relates to a directional antenna, and in particular to a directional antenna which is implemented in electronic devices.

2. Description of Related Art

Directional antennas are usually implemented in electronic devices or adapted in the electronic devices, and they can transmit or receive electromagnetic waves in a predetermined direction. After electrical signals of the electronic devices are converted into electromagnetic waves, the electromagnetic waves are transmitted through the directional antennas. In addition, the electromagnetic waves are received through the directional antennas, and then converted into electrical signals for electronic devices. Because the directional antennas transmit or receive electromagnetic waves much more in one direction than other directions, the directional antennas are suitable for signal transmission over a long distance. In this light, the directional antennas are usually used to transmit or receive electrical signals with satellites or long distance antennas.

For example, an electronic device with a global positioning system (GPS) utilizes a directional antenna to transmit/receive signals over long distance. The electronic device is usually a portable electronic device such as mobile phone. The position of the portable electronic device changes when user has different postures, and the satellite orbits around the earth. In addition, the directional antenna of GPS must be continuously directed toward the satellite so it is difficult in the prior art.

Users manually adjust the directional of the antenna in the prior art when the directional antenna does not performs very well so that the antenna is tuned to a better direction. To overcome this drawback, an omni-directional antenna is utilized and suitable for signal transmission over a long distance without manual adjustment to the antenna.

Thus, there is a need for a directional antenna which is implemented in an electronic device and properly directed toward a direction to overcome the above drawbacks.

SUMMARY OF THE INVENTION

It is an object of the present invention to provide a directional antenna which is implemented in an electronic device and properly adjusted toward a direction to achieve optimal performance. In addition, the directional antenna is adjusted or tuned toward a predetermined direction responsive to position of the electronic device to achieve optimal performance of signal transmission and receiving.

The present invention relates to a directional antenna and a portable electronic device using the same. The directional antenna is positioned on a substrate and includes at least one L-shaped radiator, at least one L-shaped oscillator, and at least one L-shaped reflector. At least one end of the L-shaped radiator is fixedly positioned on the substrate and is adjacent with and extends along edges of the substrate. At least one end of the L-shaped oscillator is fixedly positioned on the substrate and is adjacent with and extends along edges of the substrate. The at least one L-shaped reflector is fixedly positioned on the substrate and is adjacent with and extend along the L-shape radiator. With respect to the L-shaped main bodies and the L-shaped oscillators, the L-shaped reflectors are positioned near an inner side of the projection of an upper surface and lower surface of the substrate.

In particular, when the directional antenna is implemented in a portable device such as cellular phone with navigation system or global positioning system, the directional antenna needs to be tuned.

According to the present invention, the substrate is metallic, and a feed line of the L-shaped radiator is positioned near a ground terminal where the L-shaped radiator is fixedly positioned at the substrate.

Two terminals of the L-shaped radiator are fixedly positioned at the substrate, and each terminal has a pair of feed points and a ground terminal. The directional antenna further includes two switches, a gravity sensor and a processor.

The two switches of the directional antenna are fixedly positioned at the two terminals of the L-shaped radiator, and each terminal is connected with one pair of the feed points and the ground terminal through one switch. The gravity sensor is used to sense orientation of the L-shaped radiator.

Responsive to orientation of the L-shaped radiator sensed by the gravity sensor, the processor is used to control one switch so that one terminal of the L-shaped radiator is electrically connected with the pair of the feed points and the ground terminal. Meanwhile, the processor is used to control the other switch so that the other terminal of the L-shaped radiator is electrically disconnected with the other pair of the feed points and the ground terminal. Thus, the directional antenna is oriented to a predetermined direction.

According to the present invention, the directional antennal for signal transmission over a long distance and the portable electronic device utilizing the directional antenna use L-shaped structure to achieve ideal performance of signal transmission over a long distance. In addition, with the gravity sensor, the processor and the switches, the directional antenna is automatically adjusted to a predetermined direction even though orientation of the electronic device is changed at any time. Thus, the optimal signal transmission is achieved.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
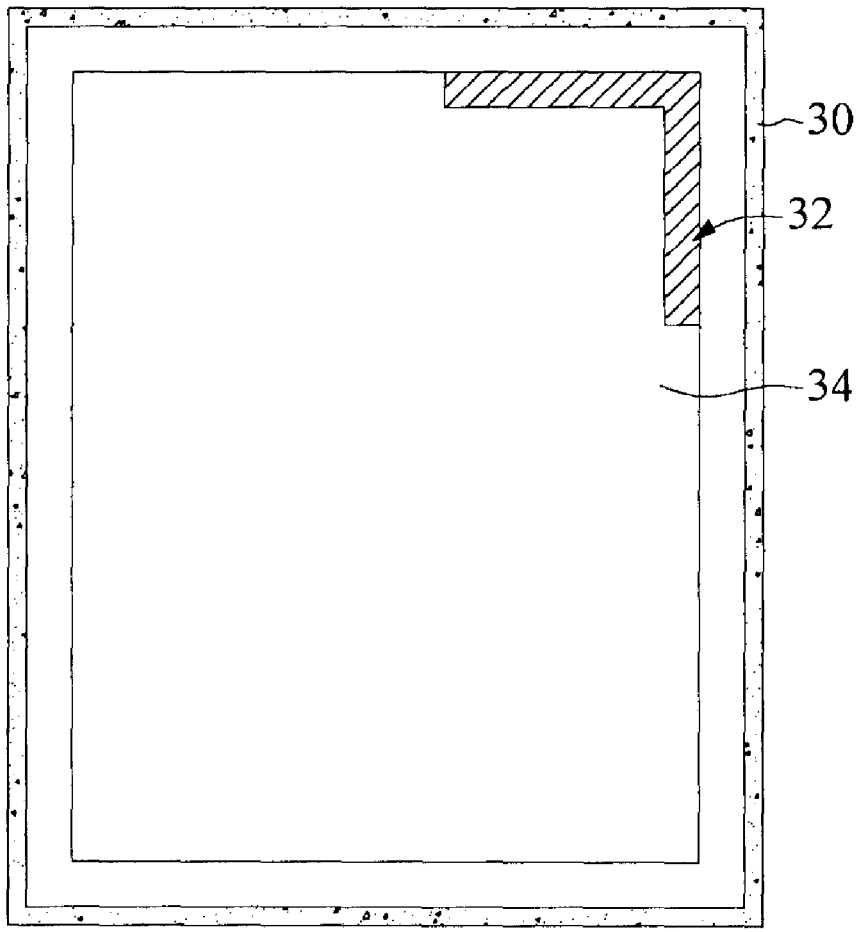
FIG. 1 is a top plan view of a directional antenna positioned at a substrate according to the present invention.

Referring to FIG. 1, FIG. 1 illustrates a perspective view of a directional antenna 32 positioned at a substrate 34. According to the present invention, the directional antenna 32 is positioned at the substrate 34 and implemented in an electronic device 30. It is preferred that the directional antenna 32 is positioned at corners of the substrate 34.

Figure 2:
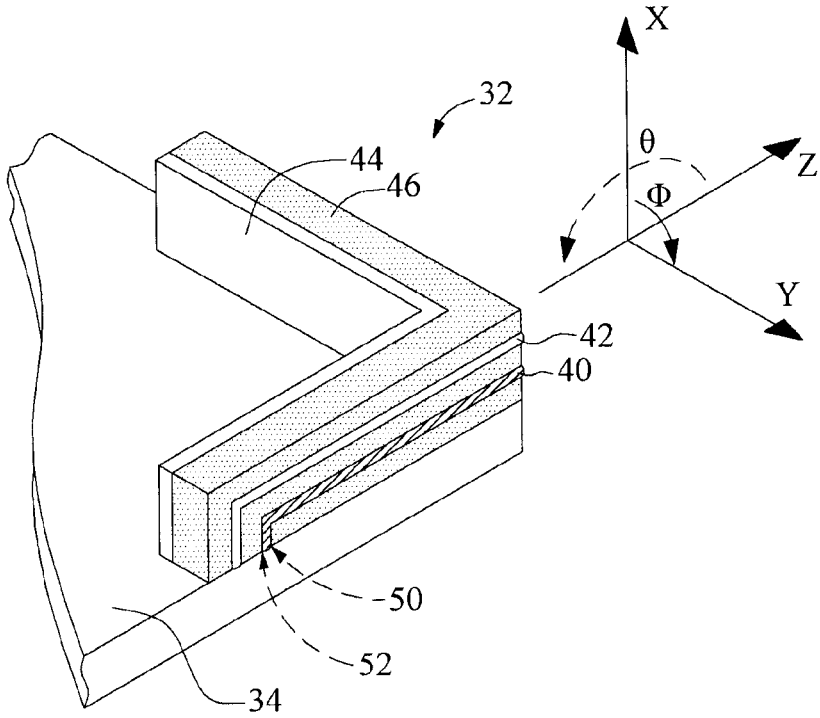
FIG. 2 is a perspective view of a directional antenna according to the present invention.

Refer to FIG. 2. FIG. 2 illustrates a perspective view of the directional antenna 32. The directional antenna 32 includes at least one L-shaped radiator 40, at least one L-shaped oscillator 42, and at least one L-shaped reflector 44.

The L-shaped radiator 40 is substantially a fold line. At least one end of the L-shape radiator 40 is fixedly positioned on the substrate 34 and is adjacent with and extends along edges of the substrate 34. As shown in FIG. 2, after the one end of the L-shape radiator 40 is fixedly positioned at the edge of the substrate 34, the L-shaped radiator 40 extends upright and away from the substrate 34. Then, the L-shaped radiator 40 turns and is adjacent with and extends along the edge of the substrate 34. The L-shaped radiator 40 turns again because of a corner of the directional antenna 32 so that the L-shaped radiator 40 is formed.

Furthermore, the L-shaped radiator 40 extends upright and away from the substrate 34 and turns, a predetermined distance between the L-shaped radiator 40 and the substrate is kept. When the L-shaped radiator 40 is implemented in vehicle or portable device with Global Positioning System (GPS), a receiving space is limited and it is preferred that the predetermined distance ranges from 3 mm to 5 mm. However, the directional antenna 32 is not only limited in use of the portable device, but also can be used in the notebook computer. If the L-shaped radiator 40 is implemented in a notebook computer, then the predetermined distance are allowed to be greater, unless 3-5 mm as mentioned above.

The L-shaped oscillator 42 is substantially a fold line. At least one end of the L-shaped oscillator 42 is fixedly positioned with the substrate 34 and adjacent with and extends along edges of the substrate 34. As shown in FIG. 2, after the one end of the L-shaped oscillator 42 is fixedly positioned at the edge of the substrate 34, the L-shaped oscillator 42 extends upright and away from the substrate 34. Then, the L-shaped oscillator 42 turns and adjacent with and extends along the L-shaped radiator 40. Then, the L-shaped oscillator 42 turns because of corner of the directional antenna 32. Thus, the L-shaped radiator 40 is made resonant and has higher gain to improve performance of signal transmission.

As shown in FIG. 2, the L-shaped reflector 44 is fixedly positioned at top surface of the substrate 34 and is a substantially wall-like structure formed by two substantially rectangular planar boards (not labeled) perpendicularly connected to each other. The L-shaped reflector 44 is adjacent with and extends along the L-shape radiator 40. With respect to the L-shaped radiator 40 and the L-shaped oscillator 42, the L-shaped reflector 44 is positioned near an inner side of the projection of an upper surface and lower surface of the substrate 34. In this light, electromagnetic waves emitted from the L-shaped radiator 40 are reflected so that the L-shaped radiator 40 receives and emits signals which are directional.

To have the directional antenna 32 firmly positioned at the substrate 34, the directional antenna 32 further includes a dielectric layer 46. As shown in FIG. 2, the L-shaped radiator 40 and the L-shaped oscillator 42 are positioned at an outer surface of the dielectric layer 46, and the L-shaped reflector 44 is positioned at an inner surface of the dielectric layer 46. Particularly, the dielectric layer 46 is mounted on the same surface of the substrate 34 as the L-shaped radiator 40, the L-shaped oscillator 42, and the L-shaped reflector 44. The dielectric layer 46 is also a substantially L-shaped, wall-like structure formed by two substantially rectangular planar boards (not labeled) perpendicularly connected to each other, and thus each of the outer surface and the inner surface of the dielectric layer 46 includes two planar surface parts (not labeled) that substantially perpendicularly intersect with each other. Also referring to FIG. 4, the two planar surface parts of the outer surface of the dielectric layer 46 are positioned to be substantially coplanar with the two edges of the corner of the substrate 34 in which the directional antenna 32 is positioned, respectively. Thus, the outer surface of the dielectric layer 46 is positioned to coincide with the corner of the substrate 34 in which the directional antenna 32 is positioned. Both the L-shaped radiator 40 and the L-shaped oscillator 42 are flatly attached on the outer surface of the dielectric layer 46, and turn corresponding to the corner of the substrate 34 and the intersection of the two planar surface parts of the outer surface of the dielectric layer 46. The L-shaped reflector 44 is flatly attached to the inner surface of the dielectric layer 46, and is perpendicularly bent corresponding to the intersection of the two planar surface parts of the inner surface of the dielectric layer 46. Two ends of the L-shaped reflector 44 are positioned to be substantially coplanar with two ends of the dielectric layer 46, respectively. In this way, the L-shaped radiator 40, the L-shaped oscillator 42, the L-shaped reflector 44, and the dielectric layer 46 cooperatively form an L-shaped, wall-like subassembly with substantially flat outer surfaces. Also referring to FIG. 1, no part of the L-shaped radiator 40 or the L-shaped oscillator 42 protrudes from the outer surface of the dielectric layer 46, and no part of the L-shaped reflector 44 protrudes from the inner surface or the two ends of the dielectric layer 46.

As shown in FIG. 2, a feed line 50 and a ground terminal 52 are positioned at right edge, and experimental values are obtained from the directional antenna 32 implemented in Global Positioning System (GPS). The directional antenna 32 is placed at the Cartesian Coordinate System, and when angle Φ is 0 degree and angle θ ranges from 0 to 180 degrees (moves along the X-Z plane), gains of the directional antenna 32 corresponding to frequency 1575.42 MHz are in the following:

| angle Φ is 0 degree | |
|---|---|
| angle θ(degree) | Gain (dBm) |
| 0 | 0.01 |
| 15 | 0.38 |
| 30 | 0.65 |
| 45 | 0.81 |
| 60 | 0.36 |
| 75 | −0.21 |
| 90 | −2.19 |
| 105 | −2.61 |
| 120 | −3.48 |
| 135 | −4.63 |
| 150 | −5.55 |
| 165 | −5.06 |
| 180 | −5.83 |

As described above, gain (dBm) of the directional antenna 32 is significant when angle θ is less than 45 degrees, and gain (dBm) of the directional antenna 32 is positive when angle θ is less than 60 degrees. Until angle θ is larger than 60 degrees, gain (dBm) of the directional antenna 32 is negative. Thus, the directional antenna 32 tends to radiate in the direction of Z-axis.

Figure 3:
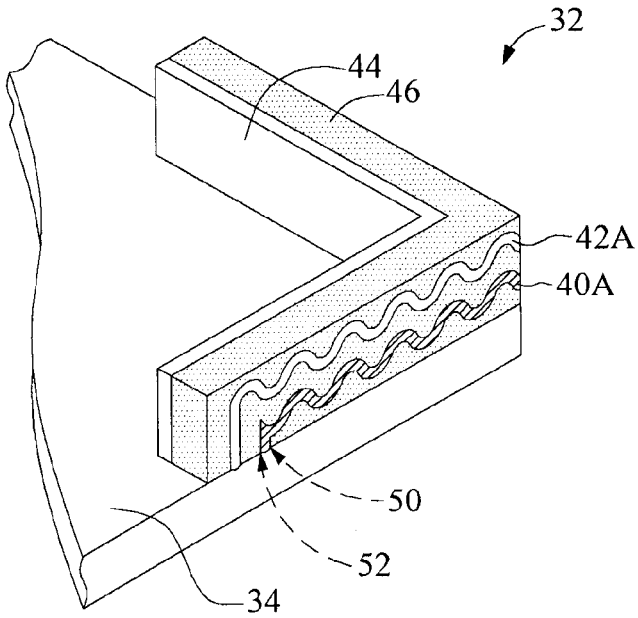
FIG. 3 is a perspective view of a directional antenna according to another embodiment of the present invention.

Refer to FIG. 3. FIG. 3 illustrates an embodiment of the directional antenna 32 according to the present invention. As described above, a L-shaped radiator 40A of the directional antenna 32 extends upright and away from the substrate 34. Then, the L-shaped radiator 40A turns and adjacent with and non-rectilinearly extends along the side edges of the substrate 34, and the L-shaped radiator 40A turns again because of corner of the directional antenna 32. The L-shaped radiator 40A continues to non-rectilinearly extend along the edges so that the L-shaped radiator 40A is formed. The embodiment discloses a non-rectilinear structure and is within the scope of the present invention.

To be compatible with the L-shaped radiator 40A, the L-shaped oscillator 42 as shown in FIG. 3 also has a non-rectilinear structure. A L-shaped oscillator 42A of the directional antenna 32 extends upright and away from the substrate 34. Then, the L-shaped oscillator 42A turns and is adjacent with and non-rectilinearly extends along the side edges of the substrate 34, and the L-shaped oscillator 42A turns again because of corner of the directional antenna 32. The L-shaped oscillator 42A continues to non-rectilinearly extend along the edges so that the L-shaped oscillator 42A is formed. When the directional antenna 32 is limited because of space, the directional antenna 32 is accommodated within limited space in accordance with the present invention.

Furthermore, when the directional antenna 32 is implemented an electronic device 30 such as mobile phone with navigation system or global positioning system, the directional antenna 32 must be tuned. Referring FIG. 4, it illustrates block diagrams of the directional antenna 32 with a switch 60 according to the present invention.

The substrate 34 is made of metal, and the L-shaped radiator 40 is fixedly positioned at a ground terminal 52 of the substrate 34 and a feed line 50 of the L-shaped radiator 40 is positioned near the ground terminal 52.

Two terminals of the L-shaped radiator 40 are fixedly positioned at the substrate 34, and each terminal has a pair of feed points 50 and the ground terminal 52. The directional antenna 32 further includes two switches 60, a gravity sensor 62 and a processor 64.

The two switches 60 of the directional antenna 32 are respectively positioned at the two terminals of the L-shaped radiator 40, and each terminal is connected with one pair of the feed points 50 and the ground terminal 52 through one switch 60. The gravity sensor 62 is used to sense orientation of the electronic device 30 by the direction of gravitational force. Furthermore, the gravity sensor 62 is used to sense orientation of the L-shaped radiator 40 within the electronic device 30 by the direction of gravitational force.

Responsive to orientation of the L-shaped radiator 40 sensed by the gravity sensor 62, the processor 64 is used to control one switch of the switches 60 so that one terminal of the L-shaped radiator 40 is electrically connected with the pair of the feed points 50 and the ground terminal 52. Meanwhile, the processor 64 is used to control the other switch of the switches 60 so that the other terminal of the L-shaped radiator 40 is electrically disconnected with the other pair of the feed points 50 and the ground terminal 52. Thus, the directional antenna 32 is directed to a predetermined direction.

Figure 4:
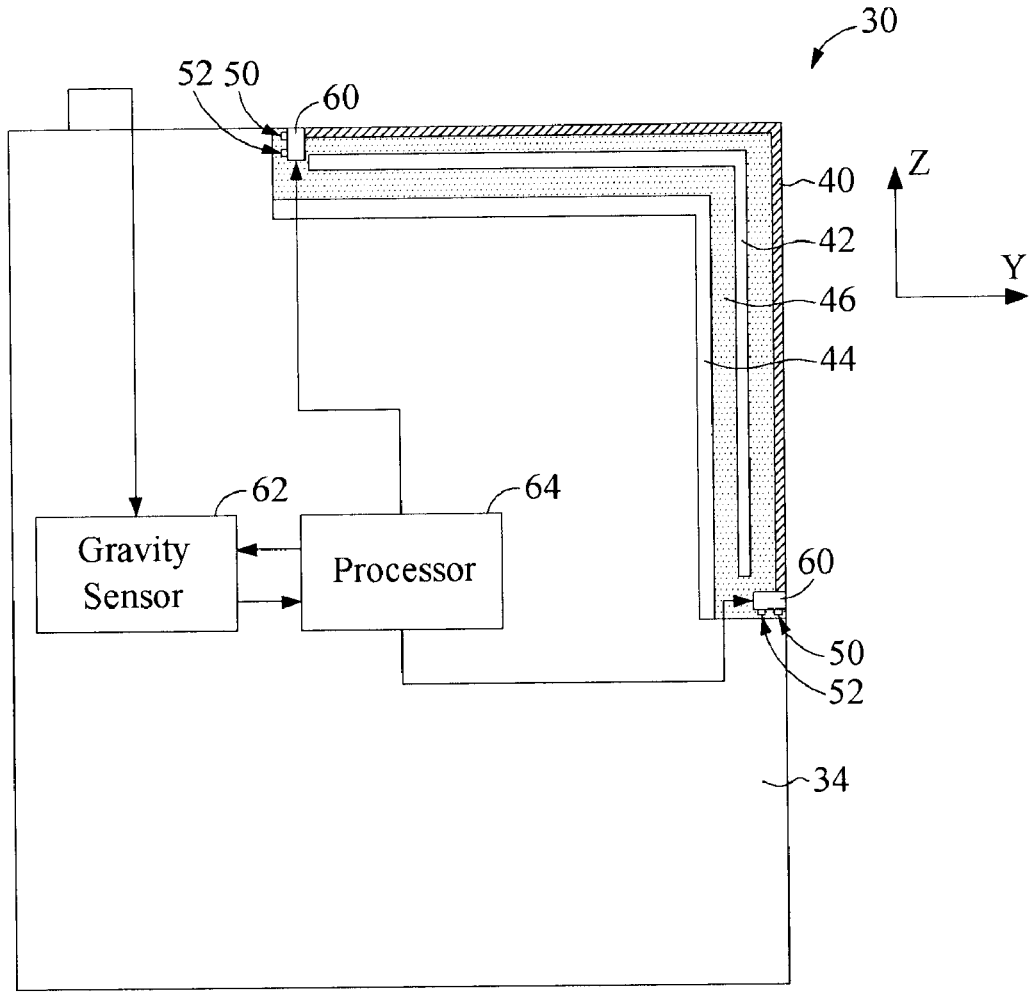
FIG. 4 is a block diagram showing a directional antenna with switches of the present invention.

Referring to FIG. 4, if the predetermined orientation is directed at the Z-axis, then the satellite is directed toward the Z-axis, i.e. opposite to the direction of gravitational force. When the gravity sensor 62 detects the orientation of the L-shaped radiator 40 such as Z-axis of FIG. 4 by the gravitational force, the processor 64 is used to control one switch 60 so that one terminal of the L-shaped radiator 40 is electrically connected with the pair of the feed points 50 and the ground terminal 52. Meanwhile, the processor 64 is used to control the other switch 60 so that the other terminal of the L-shaped radiator 40 is electrically disconnected with the other pair of the feed points 50 and the ground terminal 52. Thus, the directional antenna 32 is directed toward Z-axis.

Figure 5:
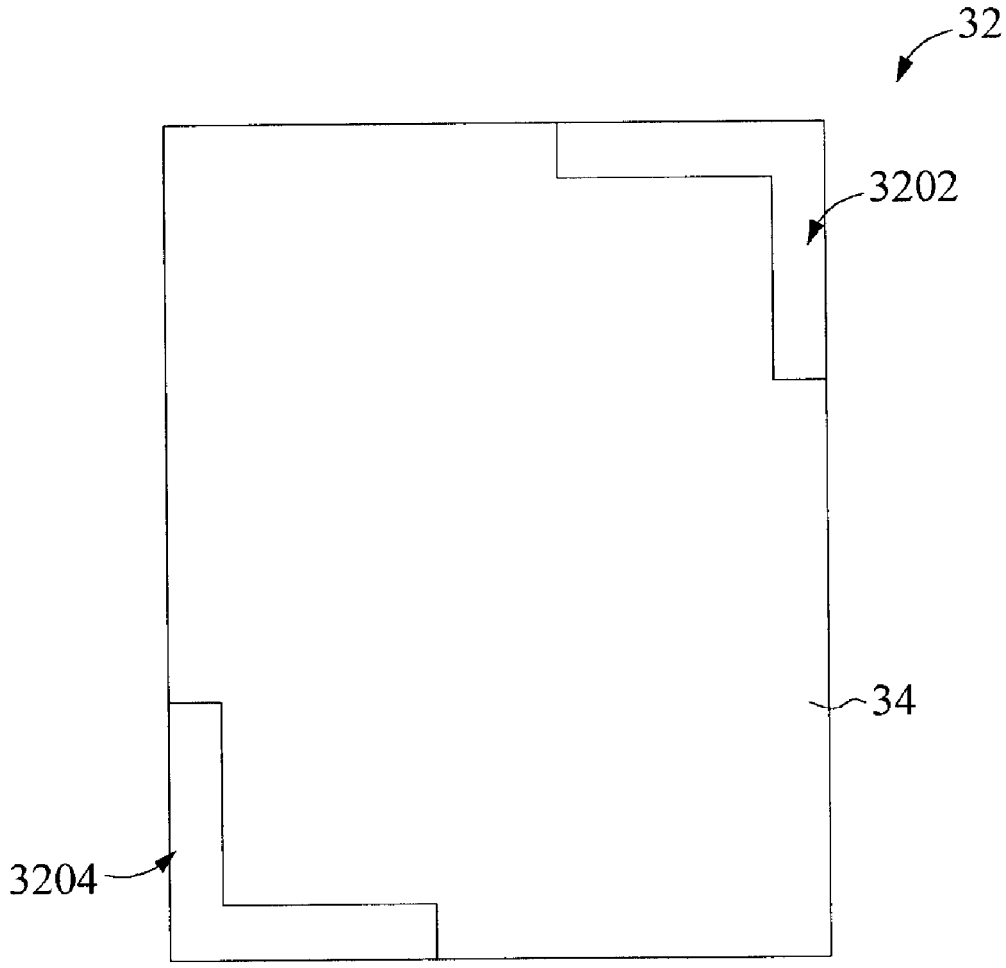
FIG. 5 is a top plan view of a directional antenna according to embodiment of the present invention.

Referring to FIG. 5, it illustrates a top plane view of the directional antenna 32 according to embodiment of the present invention. As described above, the directional antenna 32 further includes a first directional antenna 3202 and a second directional antenna 3204, and the first directional antenna 3202 and the second directional antenna 3204 are respectively positioned at two opposite corners of the substrates 34.

Figure 6:
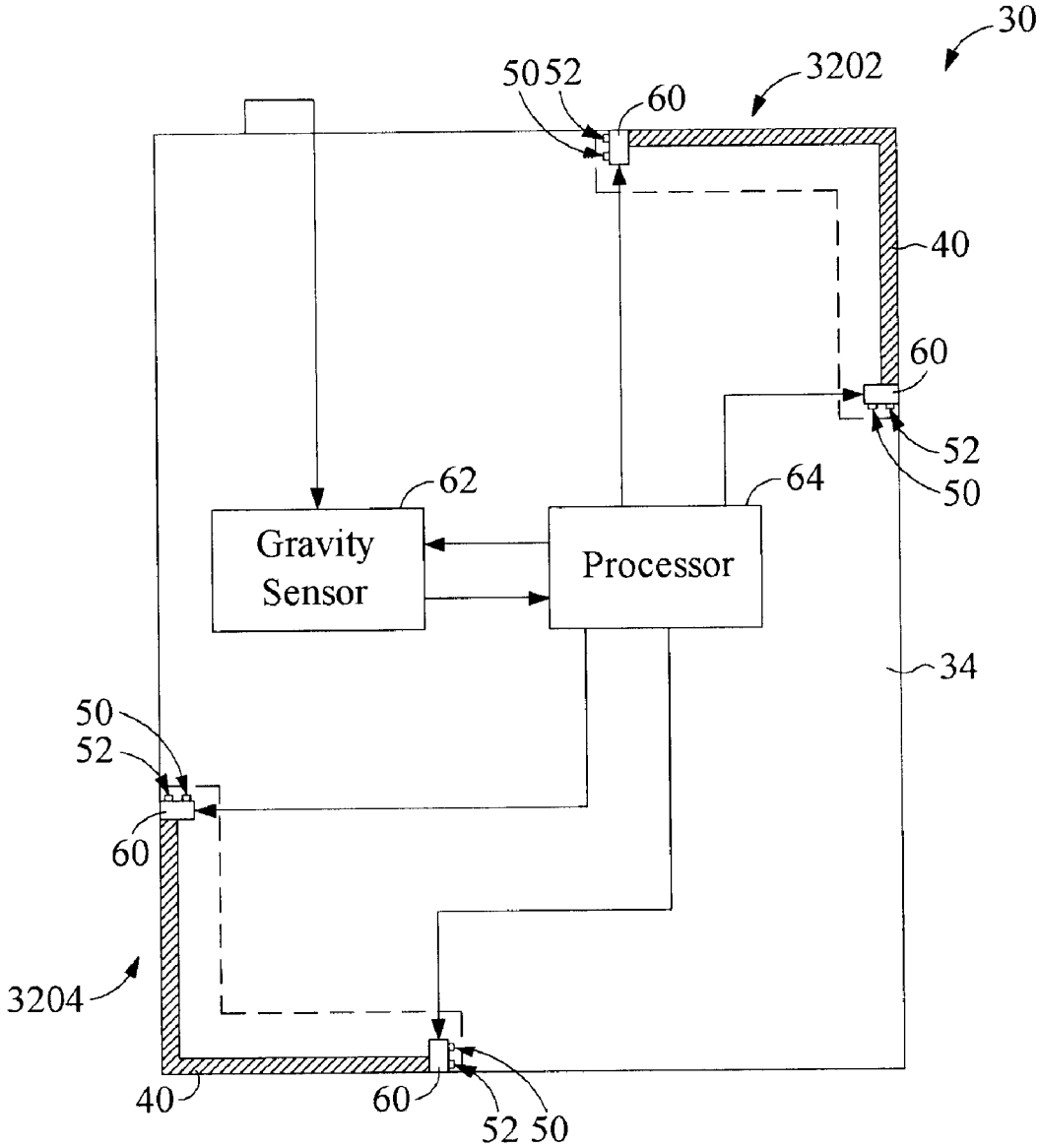
FIG. 6 is a block diagram of the directional antenna according to the embodiment of FIG. 5.

Referring to FIG. 6, it illustrates block diagram of embodiment of FIG. 5. Each of the first directional antenna 3202 and the second directional antenna 3204 includes the pair of L-shaped radiator 40, the L-shaped oscillator 42, and the L-shaped reflector 44.

The switches 60 correspond to the first directional antenna 3202 and the second directional antenna 3204, and are respectively positioned at four terminals of the L-shaped main bodies 40. Responsive to orientation of the L-shaped radiator 40 sensed by the gravity sensor 62, the processor 64 is used to control one switch 60 so that one terminal of the L-shaped radiator 40 is electrically connected with the pair of the feed points 50 and the ground terminal 52. Meanwhile, the processor 64 is used to control the other switches 60 so that the other terminal of the L-shaped radiator 40 is electrically disconnected with the other pair of the feed points 50 and the ground terminal 52. Thus, the directional antenna 32 is directed to a predetermined orientation.

Referring to FIG. 6, if the predetermined orientation is directed at the Z-axis, then the satellite is directed toward the Z-axis, i.e. opposite to the direction of gravitational force. When the gravity sensor 62 detects the orientation of the L-shaped radiator 40 such as Z-axis of FIG. 6 by the gravitational force, the processor 64 is used to control one switch 60 in the right side of the first directional antenna 3202 so that one left-sided terminal of the L-shaped radiator 40 is electrically connected with the pair of the feed points 50 and the ground terminal 52. Meanwhile, the processor 64 is used to control the other switches 60 in the left side and the lower side of the second directional antenna 3204 so that the other terminal of the L-shaped radiator 40 is electrically disconnected with the other pair of the feed points 50 and the ground terminal 52. Thus, the directional antenna 32 is directed toward Z-axis.

Therefore, according to the present invention, the directional antenna 32 for signal transmission over a long distance and the electronic device 30 utilizing the directional antenna 32 uses L-shaped structure to achieve ideal performance of signal transmission over a long distance. The electric device 30 can be a portable device such as the GPS, the smart phone, the cell phone, or the notebook computer. In addition, with the gravity sensor 62, the processor 64 and the switches 60, the directional antenna 32 is automatically adjusted to a predetermined direction even though orientation of the electronic device 30 is changing at any time. Thus, the optimal signal transmission is achieved.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. A directional antenna positioned at a substrate, comprising:

at least one L-shaped radiator, extending along and adjacent with an edge of the substrate, and at least one terminal of the L-shaped radiator fixedly positioned with the substrate;

at least one L-shaped oscillator, extending along and adjacent with the L-shaped radiator, and at least one end of the L-shaped oscillator fixedly positioned with the substrate; and at least one L-shaped reflector, fixedly positioned with the substrate and adjacent with and extending along the L-shaped radiator, wherein the at least one L-shaped reflector is positioned near an inner side of the projection of an upper surface and lower surface of the substrate with respect to the L-shaped radiator and the L-shaped oscillator; and a dielectric layer mounted on the substrate; the L-shaped radiator and the L-shaped oscillator flatly attached on an outer surface of the dielectric layer, and the L-shaped reflector flatly attached on an inner surface of the dielectric layer, such that the L-shaped radiator, the L-shaped oscillator, the L-shaped reflector, and the dielectric layer cooperatively form an L-shaped, wall-like subassembly with substantially flat outer surfaces.

2. The directional antenna as claimed in claim 1, wherein the at least one L-shaped reflector is a wall-like structure and fixedly positioned at the upper surface of the substrate.

3. The directional antenna as claimed in claim 1, wherein the L-shaped radiator extends upright and away from the substrate, the L-shaped radiator turns and extends along and is adjacent with the edge of the substrate, and the L-shaped radiator turns again and extends along with the edge of the substrate so that the L-shaped radiator is formed.

4. The directional antenna as claimed in claim 3, wherein the L-shaped oscillator extends upright and away from the substrate, the L-shaped oscillator turns and extends along and is adjacent with the L-shaped radiator.

5. The directional antenna as claimed in claim 3, wherein the L-shaped radiator of the directional antenna extends upright and away from the substrate, the L-shaped radiator turns and non-rectilinearly extends along and is adjacent with the edges of the substrate, and the L-shaped radiator turns again because of a corner of the directional antenna and non-rectilinearly extends along the edges of the substrate so that the L-shaped radiator is formed.

6. The directional antenna as claimed in claim 1, wherein the directional antenna is implemented in a portable electronic device.

7. The directional antenna as claimed in claim 1, wherein the substrate is made of metal, and the L-shaped radiator is fixedly positioned at a ground terminal of the substrate, and a feed line of the L-shaped radiator is positioned near the ground terminal.

8. The directional antenna as claimed in claim 7, wherein two terminals of the L-shaped radiator are fixedly positioned at the substrate, and each terminal has a pair of feed points and the ground terminal, the directional antenna further comprising:

two switches, respectively positioned at the two terminals of the L-shaped radiator, and each terminal connected with one pair of the feed points and the ground terminal through one switch;

a gravity sensor, used to sense orientation of the L-shaped radiator; and a processor, used to control one switch responsive to orientation of the L-shaped radiator sensed by the gravity sensor so that one terminal of the L-shaped radiator is electrically connected with the pair of the feed points and the ground terminal, and used to control the other switch so that the other terminal of the L-shaped radiator is electrically disconnected with the other pair of the feed points and the ground terminal, and the directional antenna is directed to a predetermined orientation.

9. The directional antenna as claimed in claim 8, further comprising a first directional antenna and a second directional antenna respectively positioned at two opposite corners of the substrates, each of the first directional antenna and the second directional antenna comprising the pair of L-shaped radiator, the L-shaped oscillator, and the L-shaped reflector, and four switches corresponding to the first directional antenna and the second directional antenna and respectively positioned at four terminals of the L-shaped main bodies, and wherein the processor is used to control one switch responsive to orientation of the L-shaped radiator sensed by the gravity sensor so that one terminal of the L-shaped radiator is electrically connected with the pair of the feed points and the ground terminal, and meanwhile, the processor is used to control the other switches so that the other terminal of the L-shaped radiator is electrically disconnected with the other pair of the feed points and the ground terminal, and the directional antenna is directed to a predetermined orientation.

10. The directional antenna as claimed in claim 1, wherein both the L-shaped radiator and the L-shaped oscillator are fold lines, and the dielectric layer is a L-shaped, wall-like structure including two substantially planar boards perpendicularly connected to each other, each of the outer surface and the inner surface of the dielectric layer including two planar surface parts that substantially perpendicularly intersect with each other; both the L-shaped radiator and the L-shaped oscillator turning corresponding to the intersection of the two substantially planar surface parts of the outer surface of the dielectric layer, the L-shaped reflector perpendicularly bent corresponding to the intersection of the two substantially planar surface parts of the inner surface of the dielectric layer, and two ends of the L-shaped reflector positioned to be substantially coplanar with two ends of the dielectric layer, respectively, such that no part of the L-shaped radiator or the L-shaped oscillator protrudes from the outer surface of the dielectric layer, and no part of the L-shaped reflector protrudes from the inner surface or the two ends of the dielectric layer.

11. A portable electronic device, comprising:

a directional antenna positioned at a metallic substrate of a portable electronic device, comprising:

at least one L-shaped radiator, having two terminals respectively positioned at ground terminals of the metallic substrate, and having two feed points respectively positioned near the two ground terminals so that two terminals of the L-shaped radiator respectively have a pair of feed points and a ground terminal, wherein the L-shaped radiator extends along and is adjacent with an edge of the metallic substrate;

at least one L-shaped oscillator, extending along and adjacent with the L-shaped radiator, and at least one end of the L-shaped oscillator fixedly positioned with the metallic substrate;

at least one L-shaped reflector, fixedly positioned with the metallic substrate, and adjacent with and extending along the L shaped radiator, wherein the at least one L-shaped reflector is positioned near an inner side of the projection of an upper surface and lower surface of the substrate with respect to the L-shaped radiators and the L-shaped oscillators;

a dielectric layer mounted on the substrate; the L-shaped radiator and the L-shaped oscillator flatly attached on an outer surface of the dielectric layer, and the L-shaped reflector flatly attached on an inner surface of the dielectric layer, such that the L-shaped radiator, the L-shaped oscillator, the L-shaped reflector, and the dielectric layer cooperatively form an L-shaped, wall-like subassembly with substantially flat outer surfaces;

two switches, respectively positioned at the two terminals of the L-shaped radiator, and each terminal connected with one pair of the feed points and the ground terminal through one of the switches;

a gravity sensor, used to sense orientation of the L-shaped radiator; and a processor, used to control one switch responsive to orientation of the L-shaped radiator sensed by the gravity sensor so that one terminal of the L-shaped radiator is electrically connected with the pair of the feed points and the ground terminal, and used to control the other switch so that the other terminal of the L-shaped radiator is electrically disconnected with the other pair of the feed points and the ground terminal, and the directional antenna is directed to a predetermined orientation.

12. The portable electronic device as claimed in claim 11, further comprising a first directional antenna and a second directional antenna respectively positioned at two opposite corners of the metallic substrates, each of the first directional antenna and the second directional antenna comprising the pair of L-shaped radiator, the L-shaped oscillator, and the L-shaped reflector, and four switches corresponding to the first directional antenna and the second directional antenna and respectively positioned at four terminals of the L-shaped main bodies, and wherein the processor is used to control one switch responsive to orientation of the L-shaped radiator sensed by the gravity sensor so that one terminal of the L-shaped radiator is electrically connected with the pair of the feed points and the ground terminal, and meanwhile, the processor is used to control the other switches so that the other terminal of the L-shaped radiator is electrically disconnected with the other pair of the feed points and the ground terminal, and the directional antenna is directed to a predetermined orientation.

13. The portable electronic device as claimed in claim 11, wherein the at least one L-shaped reflector is a wall-like structure and fixedly positioned at a top surface of the metallic substrate.

14. The portable electronic device as claimed in claim 11, wherein the L-shaped radiator extends upright and away from the metallic substrate, and the L-shaped radiator turns and extends along the edge of the metallic substrate so that the L-shaped radiator is formed.

15. The portable electronic device as claimed in claim 14, wherein the L-shaped oscillator extends upright and away from the metallic substrate, and the L-shaped oscillator turns again and extends along the L-shaped radiator.

16. The portable electronic device as claimed in claim 14, wherein after the L-shaped radiator is fixedly positioned at the metallic substrate and the L-shaped radiator extends upright and away from the metallic substrate and turns, a predetermined distance between the L-shaped radiator and the metallic substrate ranges 3 mm to 5 mm.

17. The portable electronic device as claimed in claim 14, wherein the L-shaped radiator extends upright and away from the metallic substrate, the L-shaped radiator turns and non-rectilinearly extends along and is adjacent with the edges of the metallic substrate, and the L-shaped radiator turns again and the L-shaped radiator continues to non-rectilinearly extend along the edges so that the L-shaped radiator is formed.

18. The portable electronic device as claimed in claim 17, wherein after the L-shaped oscillator extends upright and away from the metallic substrate, the L-shaped oscillator turns and non-rectilinearly extends along the edges of the metallic substrate, and the L-shaped oscillator turns again because of a corner of the directional antenna, and the L-shaped oscillator continues to non-rectilinearly extend along the edges so that the L-shaped oscillator is formed.

19. The portable electronic device as claimed in claim 11, wherein both the L-shaped radiator and the L-shaped oscillator are fold lines, and the dielectric layer is a L-shaped, wall-like structure including two substantially planar boards perpendicularly connected to each other, each of the outer surface and the inner surface of the dielectric layer including two planar surface parts that substantially perpendicularly intersect with each other; both the L-shaped radiator and the L-shaped oscillator turning corresponding to the intersection of the two substantially planar surface parts of the outer surface of the dielectric layer, the L-shaped reflector perpendicularly bent corresponding to the intersection of the two substantially planar surface parts of the inner surface of the dielectric layer, and two ends of the L-shaped reflector positioned to be substantially coplanar with two ends of the dielectric layer, respectively, such that no part of the L-shaped radiator or the L-shaped oscillator protrudes from the outer surface of the dielectric layer, and no part of the L-shaped reflector protrudes from the inner surface or the two ends of the dielectric layer.

* * * * *